United States Patent [19]

Adams, Sr. et al.

[11] 4,237,661

[45] Dec. 9, 1980

[54] SUPPORT STAND FOR USE WITH AN ABOVE GROUND POOL

[76] Inventors: George F. Adams, Sr.; Mary L. Adams, both of 2740 NW. 172 Ter., Miami, Fla. 33055

[21] Appl. No.: 917,546

[22] Filed: Jun. 21, 1978

[51] Int. Cl.[3] ..... E04H 3/12

[52] U.S. Cl. ..... 52/8; 4/496 R; 182/152; 182/131; 248/240.4; 312/235 R

[58] Field of Search ..... 52/8, 9, 73, 109; 297/335; 182/152, 131, 132, 159, 156; 248/240.4, 293; 4/172, 172.19; 108/108, 51.1, 53.1 R; 312/235 R

[56] References Cited

U.S. PATENT DOCUMENTS

| | | | |
|---|---|---|---|
| 582,799 | 5/1897 | Randow | 248/240.4 |
| 1,224,129 | 5/1917 | Bohn | 248/240.4 |
| 2,554,657 | 5/1951 | Betterton | 108/51.1 |
| 3,371,455 | 3/1968 | Fox | 4/172.19 |
| 3,654,639 | 4/1972 | Lankheet | 4/172.19 |
| 4,044,857 | 8/1977 | Guerette | 182/152 |

*Primary Examiner*—James A. Leppink
*Assistant Examiner*—Henry E. Raduazo

[57] ABSTRACT

A support stand for use with an above ground pool which includes a pair of collapsible, spaced, support standards and a platform spanning the support standards and supported by an arm pivotally connected to each of the two support standards, the arms being braced by a support system of pivotally interconnected brace members; and the standard may include a seat above the platform and a tray below the platform, the latter being to support articles. For shipment and storage, the stand is adapted to collapse into a compact unit.

5 Claims, 10 Drawing Figures

SUPPORT STAND FOR USE WITH AN ABOVE GROUND POOL

FIELD OF THE INVENTION

This invention relates to a collapsible stand for use in connection with a pool; and it is adapted to be collapsed into an out-of-the-way knocked-down attitude when not in use.

BACKGROUND OF THE INVENTION

As is perhaps well known pool decks are often erected about the wall of swimming pools or pools of the type for simply relaxing in cool, warm or hot water; and this invention is of such a stand.

OBJECTS OF THE INVENTION

It is an object of this invention to provide an easily installed, easily removable pool deck or support stand including a platform to extend outwardly from the rim of an above ground pool and wherein the stand includes a pair of collapsible support standards to support the platform. A seat may be provided connecting the support standards; and, below the platform, a tray may be provided to support articles thereon.

Additionally, it is an object of this invention to provide a stand of the type described which is adapted to any size pool, whether circular or oval, and wherein a platform extends a substantial distance radially outwardly from the rim of the pool and which platform is supported by spaced collapsible support standards, each of which is composed of pivotally interconnected members to support the platform or deck; and, also, if desired, a seat, above the platform, and a tray, below the platform, to support articles thereon.

It is a further object of this invention to provide an improved support standard for a pool platform stand, wherein the standard is provided with a plurality of interconnected brace members to support an outstretched platform support arm and wherein the arm and brace members are adapted to be readily collapsed when not in use.

Generally speaking, it is another object of this invention to provide an improved support standard for a pool deck or pool platform to extend outwardly from the rim of an above ground pool and wherein the material of the stand and deck may be of any suitable material, such as treated pine, redwood, cypress, or, if desired, aluminum; and wherein the stand and the support standards for the stand are adapted to be partially assembled, shipped to an installation site in a compact collapsed condition, and, at the site, readily erected to provide an easily installed pool deck or stand.

In accordance with these and other objects which will become apparent hereinafter, the instant invention will now be described with reference to the accompanying drawings in which:

DESCRIPTION OF THE PREFERRED EMBODIMENT

Figure 1:
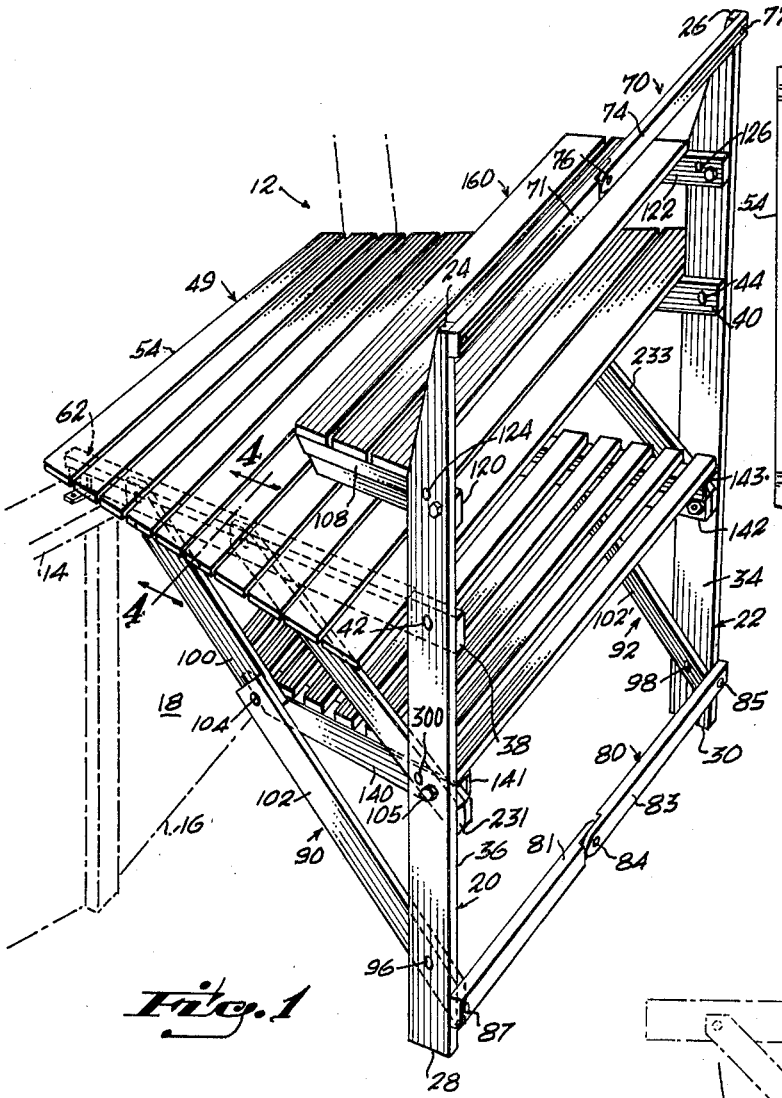
FIG. 1 is a perspective view of the stand of the instant invention.

Referring to the drawings and particularly to FIG. 1, there is shown a stand generally designated by the numeral 12. In the following description, corresponding parts in the several views will be similarly numbered.

It is seen in FIG. 1 that, after the stand is erected, the front edge of the stand is adapted to be attached in the rim 14 of an upstanding wall 16 of an above ground pool of water generally designated by the numeral 18.

Figure 2:
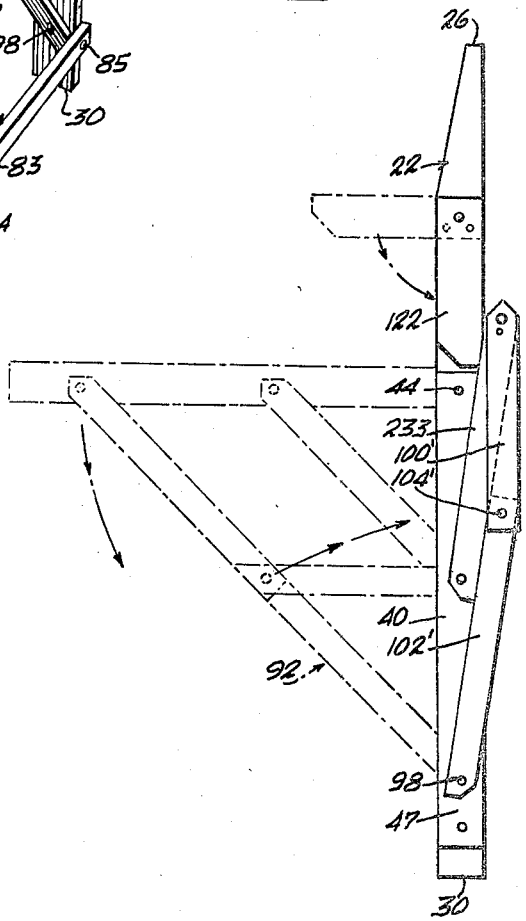
FIG. 2 is a side elevation view illustrating generaly one of the support standards composed of pivotally interconnected members arranged for swinging movement relative to the support standards after the seat support and tray have been removed.
Figure 9:
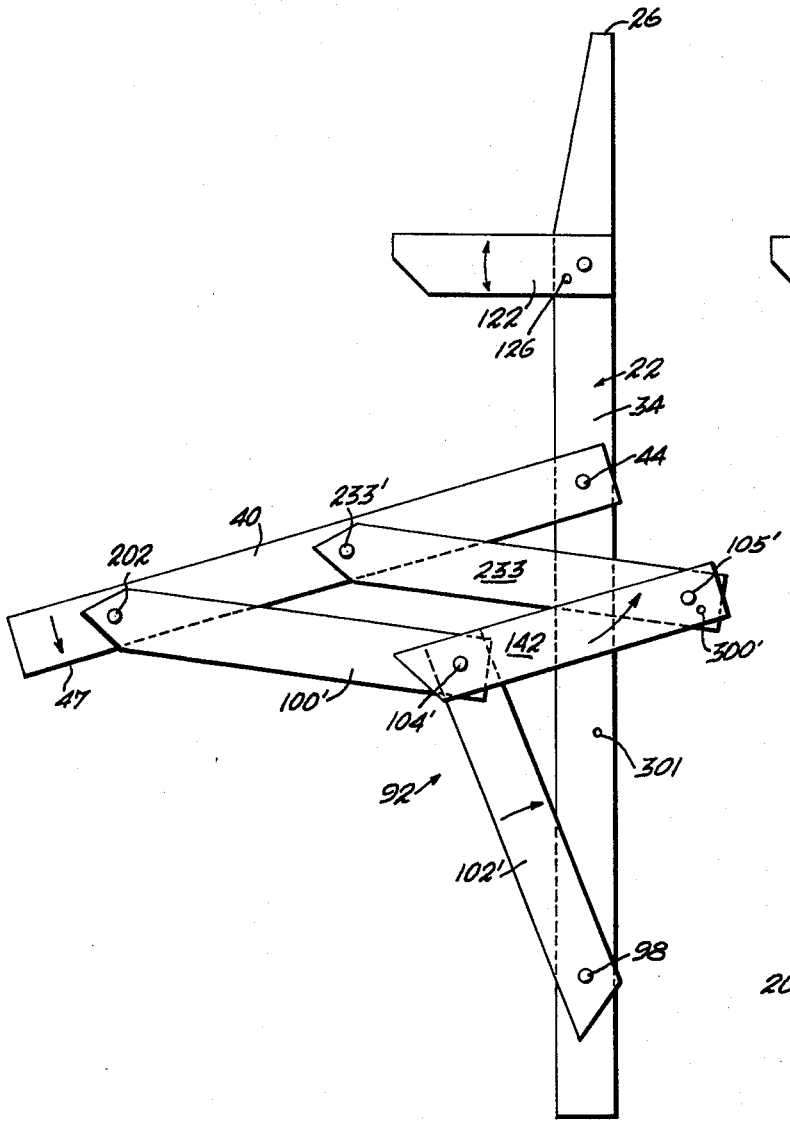
FIG. 9 and 10 are views similar to FIG. 2 and illustrating the collapsible feature of the support standards of the instant invention.
Figure 10:
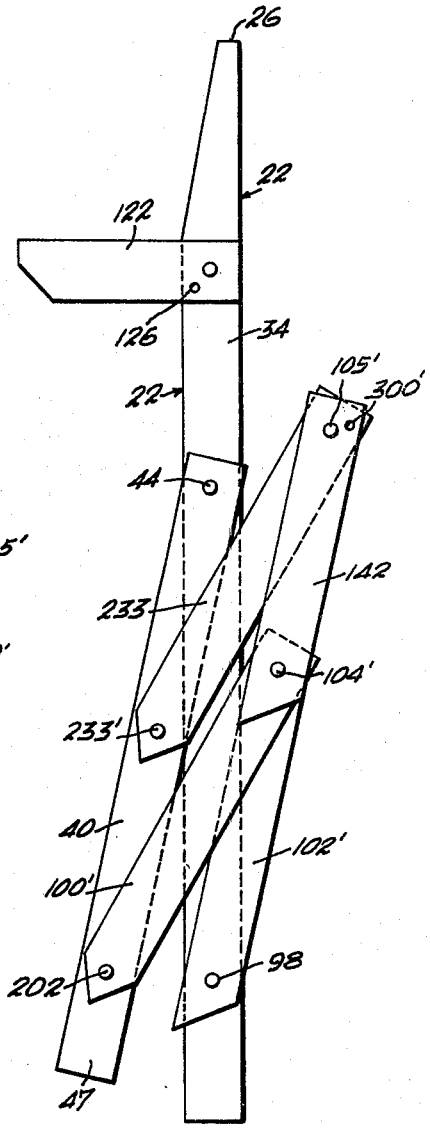

The stand is composed of a pair of spaced support standards, 20 and 22, which are each of a common length, somewhat greater than the height of the pool wall. Each has an upper end as at 24 and 26 and a lower end, as at 28 and 30, the latter being support by the ground surface in a suitable manner. Each of the support standards has an outside surface, such as 34 on standard 22 and 36 on standard 20; these outside surfaces are in confronting relation. To each of the support standards, a support arm, such as 38 and 40, is pivotally connected. Each of the support arms has an inner end and an outer end; and the arms are of a common length. Main pivot means, such as 42 and 44, are provided and each pivotally connects the inner end of one of the support arms to one of the pair of support standards at a common distance from the upper end of their respective associated support standards whereby the same are adapted for swinging movement about the pivotal connection between a horizontal alignment of the arms in a common plane with that of the rim of the pool and a collapsed attitude, as shown in FIGS. 2, 9 and 10. In the collapsed attitude the support arms are adapted to be aligned with and in overlaying relation of the confronting outside surfaces of the support standards to which they are connected, with their respective outer arm ends, such as that designated by the numeral 47 being adjacent the lower end 30 of the leg 22.

Figure 3:
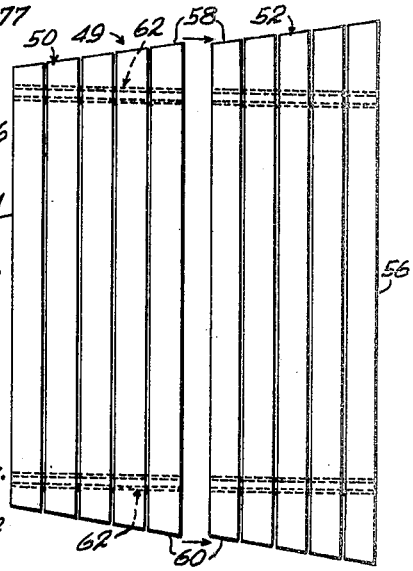
FIG. 3 is a top plan view of the support structure shown in FIG. 1.
Figure 4:
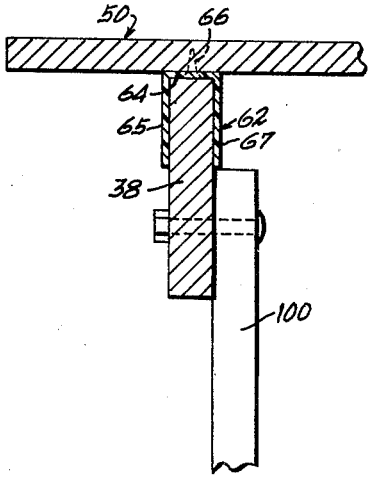
FIG. 4 is a view in cross section taken on the plane indicated by the line 4—4 of FIG. 1 and looking in the direction of the arrows.

A platform, designated by the numeral 49, is provided to span the support standards; referring to FIG. 3, the platform may be composed of two companionate portions, 50 and 52. The platform has an outer edge 54 and an inner edge 56 joined by side edges 58 and 60 which may be tapered so as to converge from the inner end toward the outer end at a common angle, whereby a plurality of such platforms may be provided to form a peripheral platform all the way around or partially around a pool rim. Referring to FIG. 4, the platform includes downwardly depending channel members designated by the numeral 62 with the web being secured as by screws 66 to the underside of the platform structure. In this preferred embodiment, the platform is composed of a plurality of strips of material, such as wood, which are interconnected by the channel members. The flanges 65 and 67 of the channel members are adapted to nest over the upper edge of the support arms and, when installed, serve to rigidify the stand structure and to maintain the legs in predetermined spaced relation as shown in FIG. 1.

The support standards 20 and 22 of the stand, see FIG. 1, may be spanned by an upper member 70 and a lower member 80. In the preferred embodiment the upper member 70 is composed of two connected sections, 71 and 74, which are pivotally interconnected as at 76 and the ends of the upper member are pivotally connected to the upper end of the associated support standard, as at 76. The pivotally interconnected sections 71 and 74 thus span the upper ends 24 and 26 of the support standards 20 and 22. The lower member 80 may be provided in spanning relation of the lower ends 28 and 30 of the support standards 20 and 22. The lower members may be composed of sections 81 and 83 pivotally connected as at 84 to one another and as at 85 and 87 to the respective support standards.

To support the outstretched platform support arms 38 and 40 for the platform or deck, a support means is provided which will now be described generally and, near the end of this specification in complete detail.

First, an elongate brace member is provided for the support arm on each support standard. Each brace member includes two pivotally interconnected lengths, first a brace leg, such as 100 and 100' and a pivotally interconnected lower support and guide leg 102 and 102'. The support and guide leg section is pivotally connected at a lower connection, such as at 96 and 98, to the lower end of one of the support standards while the upper end of each brace member, that is the upper end of the brace leg section, is pivotally connected to the arm of the associated support standard at a pivotal connection adjacent the outer arm end. In summary, the brace members 90 and 92 are pivotally connected at their respective upper ends to the support arm of the support standard and at their respective lower ends, to the support standard, and, additionally, each brace member includes an upper section denominated as a leg brace, such as 100 and 100', see FIGS. 2, 9 and 10, and a lower support guide leg, 102 and 102' which are pivotally connected to the support standard as at 96 and 98. Finally, it should be pointed out that the lower support and guide leg and the upper leg brace of each brace member are pivotally interconnected at a swingable elbow joint, defined by the pivot 104 and 104' which interconnect the same for swinging movement of the support means of each support standard through the attitude shown in FIGS. 9 and 10 and into the collapsed attitude shown in FIG. 2. It will be seen that, when the support arms, such as 40, are pivoted about the pivot connection 44 to the support standard to which it is connected into alignment with the support standard, a compact package is provided, as will be explained more fully hereinafter.

Figure 5:
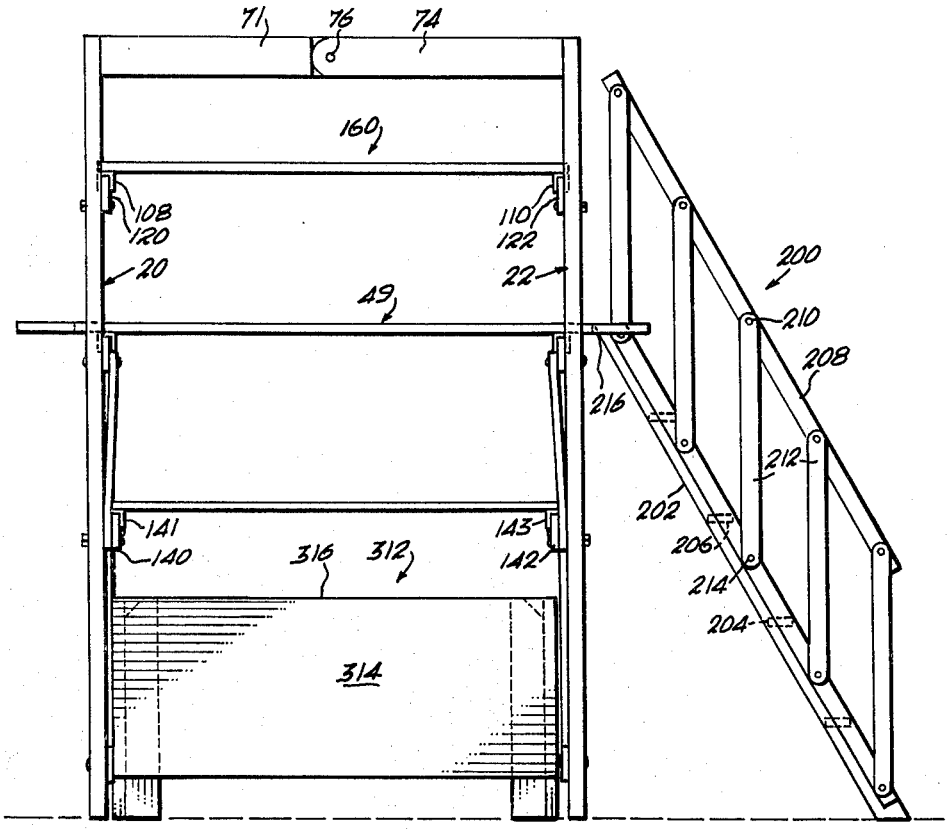
FIG. 5 is a rear elevation view of the stand shown in FIG. 1 and illustrating a set of steps for use in relation therewith and a table with a depending skirt interposed between the legs.
Figure 6:
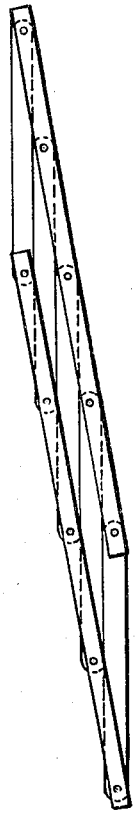
FIG. 6 is a side view illustrating the pivotal construction of the railing of the steps.
Figure 7:
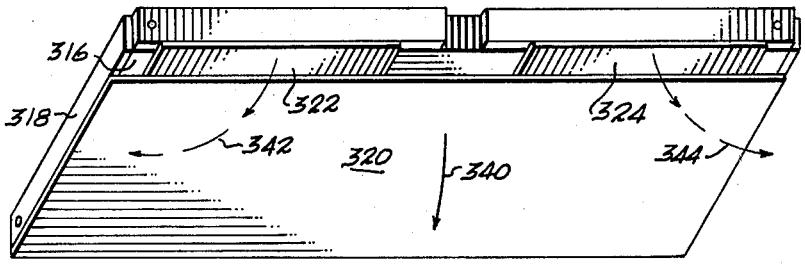
FIG. 7 is a view of the table shown in FIG. 5 and illustrating depending swingable skirt portions for supporting the same.

Above the platform, a seat generally designated by the numeral 160 may be provided. In he preferred embodiment, the seat is composed of parallel coplanar strips with a depending flange 108 and 110, see FIG. 5. These flanges are adapted to nest over and receive therein upper swingable pivotally connected seat supports 120 and 122 arranged on the upper end zones of the support standards. These seat supports are adapted to be locked into a horizontal position by pins 124 and 126.

Removable tray means may be provided to span the support standards beneath the platform and, to this end, a pair of spaced tray support arms 140 and 142 are provided. One of the support arms is pivotally connected, as at 104 and 104', that is the elbow connections, to one of the brace members, as shown in FIG. 1; and each extends inwardly to a pivot pin connection as at 300 and 300' at an intermediate zone of the associated support standard so that the same are adapted to be oriented in a horizontal attitude. The pivot pin connection 300 and 300' is an important connection because, as will be explained more fully hereinafter, when this pin is removed, and the platform tray and seat have been removed from spanning relation of adjacent support standards, the entire stand is adapted to be pivotally collapsed, as shown in FIGS. 9 and 10. The tray may be provided with depending flange members as indicated by the numerals 141 and 143 in FIG. 5 to receive the tray support arms.

The tray may have a vertically extending rim if desired and be attached in any suitable manner, for example, as a slide-out or rollable tray. The rim prevents objects on it from spilling easily.

It will be appreciated upon reference to FIGS. 9, then 10, and, finally, FIG. 2, that there has been provided a collapsible support standard for use in a deck stand so that, when the seat, deck and tray have been removed, the arms are adapted for swinging movement into the collapsed attitude shown in FIG. 2 by movement through the attitude shown in FIGS. 9 and 10, for ease of transportation and storage of the stand when not in use. Also, the configuration of the side edges of the deck or platform of the support standards are such as to mate with similarly constructed decks or platforms of adjacent stands so as to provide a peripheral deck about the entire perimeter of a pool if desired and the front edge of the deck may match the contour of the pool rim to which it is attached.

The stand may include a set of steps, for example that designated by the numeral 200 comprising a pair of runners such as that designated by the numeral 202 which are spanned by steps 204 and 206, for example, and wherein a railing 208 is provided and which is pivotally connected as at 210, for example to upstanding members such as 212 which are pivotally connected at their lower ends as at 214, to the runners. A suitable and conventional attachment means may be provided to connect the runners to the support as at 216.

Figure 8:
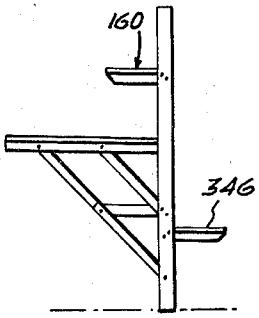
FIG. 8 is a side elevation view of the instant invention provided with a lower outwardly extending seat means.

Between the legs of the stand a support table may be provided to hold articles, the support table being generally designated by the numeral 312. It includes an upper surface and a depending skirt generally designated by the numeral 314. Within the skirt of the table, various pool items, such as the pool pump, a filter, and in the case of a hot tub, a water heater, and also, bottles of chlorine may be stored in an out-of-the-way position. The table structure includes an upper surface 316 with a downwardly extending peripheral flange as designated by the numeral 318 and skirt portions, such as 320, 322 and 324 which are hingedly connected for swinging movement in the direction of the arrows 340, 342 and 344. Finally, as shown in FIG. 8 a lower seat 346 may be provided for persons to rest who do not desire to sit on the upper seat looking in the pool.

It is thus seen that there has been provided a simple and inexpensive collapsible stand for use adjacent a pool with the front edge being supported on the pool rim, conforming to its contour; and which stand may be collapsed when not in use and readily erected and shipped to a convenient site for a simple installation. If desired, although not shown in the drawings, a vertical support leg may be provided for additional support. The same may be in the form of an additional leg to connect to the deck support arm and extend downwardly to the ground adjacent the outer edge of the pool deck.

It will be helpful to refer in detail to the support standard structure on reference to FIGS. 9, 10 and 2 in connection with the following paragraph. It is seen that a collapsible platform or deck support member is provided which is composed of a generally vertical standard having an upper end and a lower end and being of a first predetermined height and having a main longitudinally extending mounting surface. A main upper pivot pin means 44 is provided at a predetermined location adjacent the upper end of the standard. A main normally horizontal oriented support arm 40 extends outwardly from the main upper pivot pin means. The arm has an inside surface and an outside surface and an inner end and an outer end and is of a length less than the distance between the location of the main pivot pin means and the lower end of the support standard. The main pivot pin means connects the inner end of the arm at this predetermined location, connecting it to the support standard, with the inside surface of the main support arm confronting the outside surface of the leg or support standard. A first and second equilength brace leg, 100' and 233, each with an inside surface and an outside surface and with an upper end and a lower end are provided to support the support arm. First pivot pin means 202 connect the upper end of the first brace leg 100' to the main support arm 40 adjacent the outer arm end with the inside surface of this leg confronting the outside surface of the arm. Second pivot pin means 233' connect the upper end of the second brace leg 233 to the arm intermediate the first pivot pin means 202 and the main upper pivot pin means 44 with the inside surface of the leg 233 confronting the outside surface of the arm. Beneath the main support arm 40, a normally horizontally oriented support arm 142 is provided which has an inner end and an outer end and an inside surface and an outside surface. This normally horizontally oriented support arm is of a length less than the distance along the outside surface of the main support arm between the first and second pivot pin means 202 and 233' connecting the legs to the main arm. Third pivot pin means 104' pivotally connect the outer end of this support arm to the lower end of the first brace leg 100' with the inside surface of these disc support arm confronting the outside surface of the first leg 100'. Fourth pivot pin means 105' connect the inner end of the support arm 142 to the lower end of the second brace leg 233 with the inside surface of the support arm confronting the outside surface of the support leg. It will be seen that by reason of this construction, the first leg 100' between the first and third pivot means 202 and 104', and the second brace leg 233 between the second and fourth pivot pin means 233' and 105' and the main support arm between the first pivot pin means 202 and the second pivot pin means 233' and, finally, the support arm 142 between the third and fourth pivot pin means 104' and 105' form a collapsible rectangular frame which is swingable about the main pivot pin means 44. Finally, a support and guide leg 102' is provided for the collapsible rectangular swingable frame composed of the arm 40, the depending pivotally connected legs 100' and 233' and the shorter support arm 142. This support and guide leg also has an inner end and an outer end and an inside surface and an outside surface. A main lower pivot pin 98 is provided to pivotally connect the lower end of the support and guide leg adjacent the lower end of the support standard with the inside surface of the support and guide leg confronting the outside surface of the support standard. The upper end of the support and guide leg is connected to the third pivot pin means 104' with the outside surface of the upper end of the support and guide leg confronting the inside surface of the first brace leg. By reason of this structure, it is seen that, when the pin 300 has been removed from the lock hole 300' through the support arm 142 and brace leg 233 and from the hole 301 in the support standard, the simple removal of this pin permits the elbow type flexing of the pivot pin 104' to accommodate pivotal movement of the collapsible rectangular frame structure as guided by the pivotally connected guide and support leg 102' through the movement indicated in FIGS. 9 and 10 to a collapsed condition shown generally in FIG. 2.

The instant invention has been shown and described in what is considered to be a preferred embodiment of a stand to be attached to the rim of an upstanding wall of predetermined height about a pool to support a pool deck and a preferred support stand structure has been set forth, while it is recognized that departures may be made therefrom within the scope of the claims which are set forth hereinafter and which should not be limited except by the doctrine of equivalence.

What is claimed is:

1. A collapsible stand support comprising:

a standard having an upper end and a lower end and being of a first predetermined height and having a main longitudinally extending surface;

main upper pivot pin means at a predetermined location between said upper end and said lower end and adjacent said upper end, a main normally horizontally oriented support arm having an inside surface and an outside surface and having an inner end and an outer end and being of a length less than the distance between said predetermined location and said lower end;

said main pivot pin means connecting said inner end of said support arm at said predetermined location to said leg with the inside surface of said main support arm confronting the outside surface of said support standard;

a first and second equilength brace leg each with an inside surface and an outside surface and with an upper end and a lower end;

first pivot pin means connecting the upper end of said first brace leg to said main support arm adjacent the other end of said support arm with the inside surface of said leg confronting the outside surface of said support arm;

second pivot pin means connecting the upper end of said second brace leg to said support arm intermediate said first pivot means and said main pivot means with the inside surface of said second brace leg confronting the outside surface of said arms;

a normally horizontally oriented support arm having an inner end and an outer end and an inside surface and an outside surface and of a length less than the distance along the outside surface of said main support arm between said first pivot means and said second pivot means connecting the upper ends of said legs to said arm;

third pivot pin means connecting the outer end of said support arm to the lower end of said first brace leg with the inside surface of said support arm confronting the outside surface of said first leg;

fourth pivot pin means connecting the inner end of said support arm to the lower end of said second brace leg with the inside surface of said support arm confronting the outside surface of said second leg, said main support arm, said support arm, and said brace legs defining a collapsible rectangular frame swingable with said arm about said main pivot means;

a support and guide leg having an upper end and a lower end and an inside surface and an outside surface, main lower pivot pin means connecting the lower end of said support end guide leg adjacent the lower end of said support standard with the inside surface of said support end guide leg confronting the outside surface of said support standard, and the upper end of said support and guide leg being connected to the third pivot means defining a swingable elbow connection, the outside surface of the support and guide leg confronting the inside surface of the first brace leg; and removable lock pin means to removably connect the lower end of the second leg and the second brace leg adjacent said fourth pivot means in a hole provided in said support standard intermediate said main upper pivot pin means and said main lower pivot pin means.

2. The device as set forth in claim 1 wherein a second support member is provided in spaced relationship and a deck is provided in spanning relation of the main support arms of said support standards including means to connect to said support arms and to maintain said support arms in spaced relation.

3. The device as set forth in claim 1 wherein a seat support means are provided on said support standard between said upper end and said main upper pivot pin means.

4. The device as set forth in claim 2 wherein means are provided to interconnect the upper ends of said support standards and the lower ends of said support standards.

5. The device as set forth in claim 4 wherein said means include a pivotal connection intermediate the support standards for collapsing said support standards of said stand.

* * * * *